United States Patent [19]

Thomas

[11] Patent Number: 4,687,036

[45] Date of Patent: Aug. 18, 1987

[54] HANDBAG OR BACKPACK WITH A FLAP CLOSURE

[76] Inventor: Johnnie Thomas, 1320 Gust La., Chesapeake, Va. 23323

[21] Appl. No.: 795,853

[22] Filed: Nov. 7, 1985

[51] Int. Cl.[4] ..... A45C 3/06; A45C 13/10; A45C 13/20

[52] U.S. Cl. ..... 150/118; 150/107; 224/236; 383/31; 383/86

[58] Field of Search ..... 150/118, 100, 107, 108, 150/109; 383/4, 86, 13, 31, 86.1, 86.2; 224/205, 209, 236, 259, 257; 190/118, 119

[56] References Cited

U.S. PATENT DOCUMENTS

| | | | |
|---|---|---|---|
| 432,607 | 7/1890 | Dwyer | 224/236 X |
| 447,669 | 3/1891 | Dwyer | 224/236 X |
| 952,375 | 3/1910 | Stanley | 383/86 X |
| 1,166,612 | 1/1916 | Macaulay | 190/118 X |
| 1,182,580 | 5/1916 | Maxfield | 383/86 X |
| 1,467,919 | 9/1923 | Blumenthal | 383/86 X |
| 1,690,046 | 10/1928 | Ament | 383/86 X |
| 2,210,351 | 8/1940 | Westendorf | 190/118 X |
| 2,456,247 | 12/1948 | Bernau | 224/209 |

FOREIGN PATENT DOCUMENTS

| | | | |
|---|---|---|---|
| 452776 | 11/1948 | Canada | 383/2 |
| 3315518 | 5/1985 | Fed. Rep. of Germany | 150/107 |
| 2329226 | 5/1977 | France | 383/86 |

*Primary Examiner*—Stephen Marcus
*Assistant Examiner*—Sue A. Weaver
*Attorney, Agent, or Firm*—Lackenbach, Siegel, Marzullo & Aronson

[57] ABSTRACT

A handbag is disclosed comprising pouch with a flap, a pulley drawstring means, and a fulcrum means. Preferably the drawstring runs in a continuous circuit through the edge of the flap and the fulcrum means. Opening the flap pulls the drawstring in one direction; pulling the drawstring in the other direction closes the flap. A preferred fulcrum is a pair of loops, one on each side of the handbag. Balancing loops above the pulley loops and one or more tension loops between the pulley loops and the balancing loops are optional. This same invention may be applied to a backpack.

13 Claims, 5 Drawing Figures

HANDBAG OR BACKPACK WITH A FLAP CLOSURE

BACKGROUND OF THE INVENTION

This invention relates to a novel type of handbag for women or men, designed to be worn over the shoulder or carried by hand. Likewise, it may be used for a backpack.

Conventional handbags are designed to be opened and closed by locks, metal hardware, snaps, zippers, nylon fibers (e.g. VELCRO), buckles, or other ancillary mechanisms. This requires materials other than the bag fabric or strap, itself, and greatly increases the cost. Furthermore, with conventional handbags the opening/closing hardware or mechanism is a stressed part, which often breaks or becomes disfunctional long before the bag itself is worn out.

It is an object of the present invention to provide a handbag with a firm closure and easy opening without hardware; likewise for a backpack.

It is a further object of the present invention to provide a handbag which is secure and frustrating to potential pickpockets.

It is an additional object of the present invention to provide a handbag which is aesthetic and stylish.

It is yet a further object of the present invention to provide a handbag which can be opened and closed quickly and easily.

It is another object of the present invention to provide a handbag which can be manufactured in high volume at minimal cost; likewise for a backpack.

It is yet an additional object of the present invention to provide a handbag, wherein the opening and closing method can be made of the same fabric or material as the handbag itself; likewise for a backpack.

SUMMARY OF THE INVENTION

All the objects of the present invention and others, evident to those skilled in the art, are fulfilled by a pouch with flap, wherein the flap is opened and closed in coordination with a drawstring, rope, band, belt, or chain operating as a pulley.

A pulley is a simple machine, whereby the direction of force of pulling on a drawstring, rope, band, belt, or chain is changed by a support, post, sheave, fixed loop, or other fulcrum. In the handbag of the present invention one pulls on a flap to open the handbag and concommitantly pulls a drawstring, rope, band, belt, or chain in one direction. One closes the handbag by pulling on the drawstring, rope, band, belt, or chain in the opposite direction. For both opening and closing the handbag one or more supports, posts, sheaves, fixed loops, or fulcra are provided so that the pulling on either the flap or band is translated into movement of the other. For this action to take place it is necessary that the rope or band pass through the flap.

DESCRIPTION OF THE PREFERRED EMBODIMENTS

Figure 1:
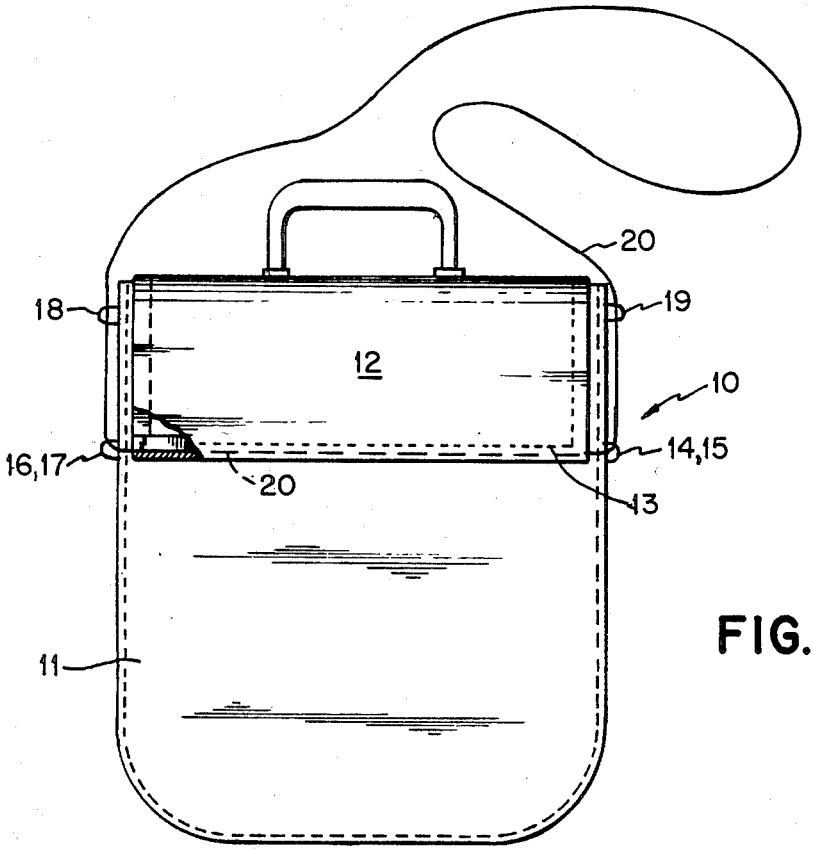
FIG. 1 is a front view of an embodiment of the invention, wherein a drawstring is employed and the pulley fulcrum is two fixed loops on each side of the handbag, made of the same drawstring material.
Figure 2:
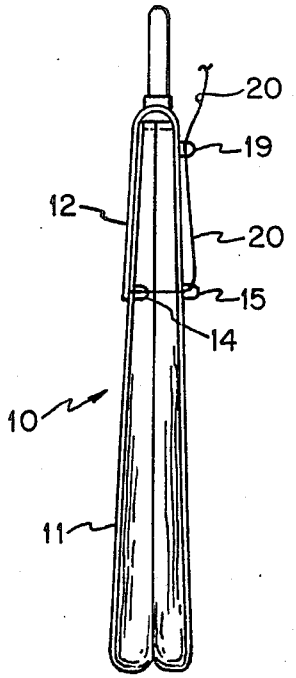
FIG. 2 is a right, side, elevational view of the handbag of FIG. 1, showing an additional balancing loop above the two pulley loops.

FIGS. 1 and 2 illustrate a handbag of the present invention, generally designated as reference numeral 10, comprising a pouch 11 with a flap 12. The sewn edge 13 of the flap may be straight, or cut with a bias, curved, or other shape.

Preferably there are two pulley loops 14 and 15 on the front and back of one side of the bag and two pulley loops 16 and 17 on the front and back of the other side. Theoretically, the present invention requires only one fulcrum, loop, sheave, or post on each side of the flap, but two on each side is preferred. More pulley loops could be used, but are not necessary.

Preferably near the top of the bag where the flap commences, balancing loops 18 and 19 are found on each side. More balancing loops, posts, or fulcra are possible, but are not necessary. The handbag would be functional without any balancing loops, but one per side is preferred.

Drawstring 20 forms a continuous circuit running through all the loops and the flap. Preferably the drawstring goes through the edge of the flap but this is not required. Ideally the drawstring is long enough to be a shoulder strap, but this is not necessary to the invention. In place of a drawstring, a cord, rope, belt, band, chain, or wire may be employed. The cross-section of the drawstring or belt may be of any convenient shape, but a circular cross-section or other cross-section with minimal friction with the flap and loops, or other fulcra, is preferred.

Figure 3:
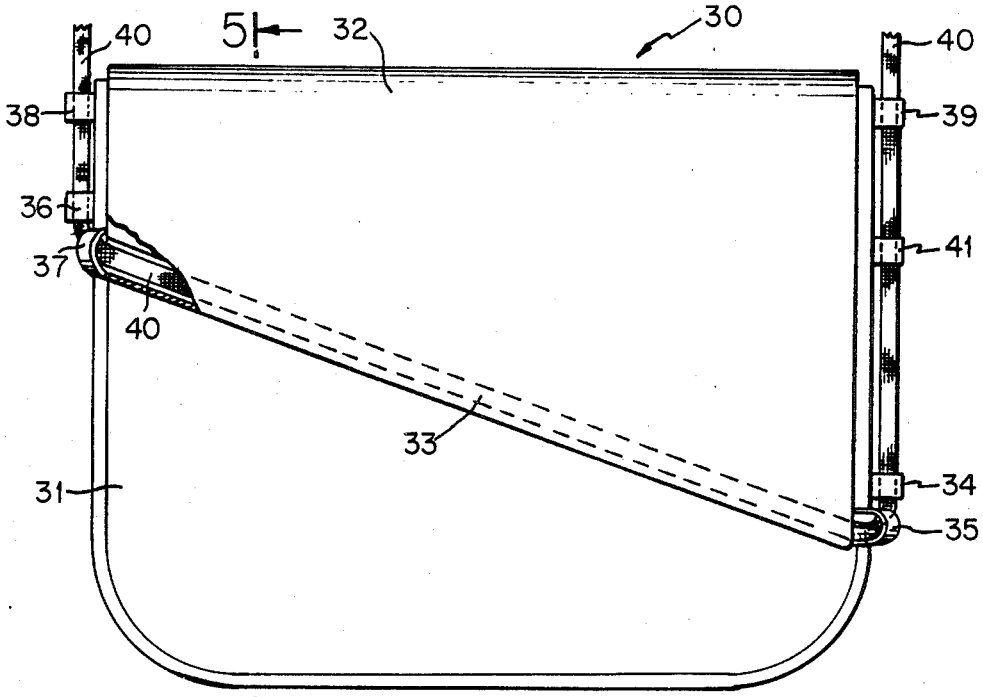
FIG. 3 is a front view of another embodiment of the present invention showing a flap cut on a bias.
Figure 4:
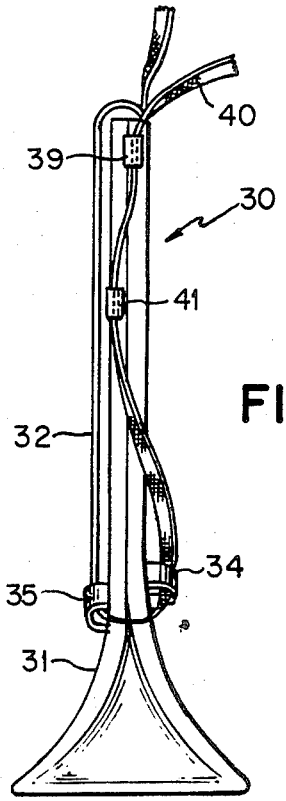
FIG. 4 is a right side, elevational view of the handbag of FIG. 3, showing a tension loop above the two pulley loops and below a balancing loop.

FIGS. 3 and 4 illustrate another embodiment of the invention generally designated as reference numeral 30. The pouch 31 is integral with flap 32, but need not be. The sewn edge 33 is cut on the bias. In addition to pulley loops 34 and 35 on the side near the bottom of the biased edge and pulley loops 36 and 37 near the top of edge 33 on the other side of the handbag, there are balancing loops 38 and 39. Furthermore, on the side vicinal to the longer side of flap 32 there is a mid-loop 41, called a tension loop. One or more tension loops are optionally useful in the present invention to help keep drawbelt 40 tight, when the flap 32 is closed. Preferably tension loop 41 is fixed on the front of the side of the handbag, especially if balancing loop 38 is on the back of the side of the handbag, but this position is not necessary to the invention.

The drawbelt could have a pair of positioning buckles, or similar means, to increase or decrease the length of the hang from the shoulder, if desired.

Figure 5:
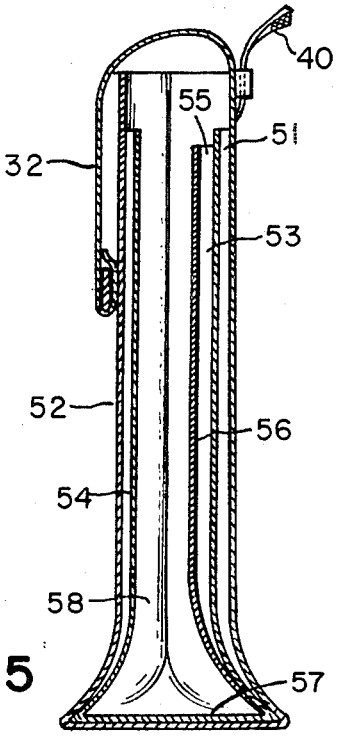
FIG. 5 is a cross-section elevation view along the line 5—5 of FIG. 3 of the interior of a handbag of the present invention showing dividers, pockets, and a removable base insert.

FIG. 5 illustrates the interior of a handbag of the present invention. Preferably there are two large pockets 51 and 52 created by sewn dividing pieces 53 and 54. Any convenient number of pockets or dividers may be optionally present. A smaller pocket 55 is created by a smaller sewn piece 56 on dividing piece 53. Optionally, but not required, is a removable insert piece 57 to give shape to central compartment 58. The interior of the handbag of the present invention may be structured and divided in any conventional way known to the art. Likewise for a backpack.

The material of the handbag may be any flexible material or fabric useful for handbags, purses, and the like. Leather, nylon fabric, velvet, vinyl substitute leather, polyurethane fabric, polypropylene fabric, cotton, wool, silk are representative useful materials for the practice of this invention. Likewise for a backpack.

Normally the drawstring, rope, band, belt, or metallic chain of which the pulley is made will be of the same fabric, material, and color as the handbag, but this is not necessary. Although it would be easier and cheaper for a manufacturer to limit the materials, weights, hand, and color of the components to be made and processed, one may choose to contrast the material, weight, color of the components to be made and processed. One may choose to contrast the material, weight, color, and hand in constructing the handbag and pulley and loops or fulcra of the present invention.

Preferably the flap of the handbag of the present invention is integral with the pouch, but this is not necessary to the invention. The pouch and flap can be sewn from a plurality of pieces if desired. The novel handbag can be tightly sewn from various pieces of the same or different material, color, weight, finish, or hand and still function as if it were truly of one piece. Likewise the drawstring, belt, band, rope, or chain of the strap functioning as a pulley can be tightly fastened from various pieces and still function as if it were one piece.

Of the 18 basic styles of handbags described in the booklet "All About Handbags" distributed by the National Handbag Association, 350 Fifth Avenue, Empire State Building, New York, N.Y. 10001, the present invention would be more useful for the Shoulder, Vagabond, and Chanel types, but it is possible that the present invention could be useful in the Envelope, Clutch, or other types also.

Although most handbags utilizing the present invention will be carried by means of a shoulder strap or drawstring, the present invention may also be employed for handbags having one or more handles in addition to or instead of a shoulder strap. This invention may also be applied to a backpack.

Preferred embodiments of the present invention have been described and illustrated in the accompanying Figures by way of example. Numerous modifications thereof may be made without departing from the spirit and scope of the invention for which letters patent are sought, as defined by the following claims:

I claim:

1. A handbag comprising a pouch having an opening and a flap for closing said opening, at least one pair of pulley loops attached externally to the sides of said pouch, and a single, continuous drawstring means passing through the external loops and enclosed by and passing through a sewn edge of the flap transverse to the opening, whereby opening the flap pulls the single, continuous drawstring means in one direction and pulling the drawstring means oppositely closes the flap.

2. A handbag as in claim 1, wherein the pouch with an opening and a flap is made of a material selected from the group consisting of leather, vinyl substitute leather, nylon, velvet, polyurethane fabric, polypropylene fabric, cotton, wool, and silk.

3. A handbag as in claim 1, wherein the drawstring means is made of a material selected from the group consisting of leather, vinyl substitute leather, nylon, velvet, polyurethane fabric, polypropylene fabric, cotton, wool, silk, and metallic chain.

4. A handbag as in claim 1, wherein said handbag is of a type selected from the group consisting of shoulder, vagabond, Chanel, envelope, and clutch types.

5. A handbag as in claim 1, wherein the handbag also has one or more handles.

6. A handbag as in claim 1, wherein the single, continuous drawstring means also passes through a pair of balancing loops each of which is attached externally to the handbag on one side of the pouch fitted above the pulley loops.

7. A handbag as in claim 6, wherein the single, continuous drawstring means passes through at least one tension loop fitted externally to the pouch between one of said pulley loops and balancing loops.

8. A handbag as in claim 7, wherein all the external loops are made of soft, flexible material.

9. A handbag as in claim 7, wherein all the external loops are made of the same material as the pouch with a flap.

10. A handbag as in claim 8, wherein all the external loops are made of the same material as the drawstring means.

11. A bag in the form of a backpack comprising a pouch having an opening and a flap for closing said opening, at least one pair of pulley loops attached externally to the sides of said pouch, and a single, continuous drawstring means passing through the external loops and enclosed by and passing through a sewn edge of the flap transverse to the opening, whereby opening the flap pulls the continuous drawstring means in one direction and pulling the drawstring means oppositely closes the flap.

12. A backpack as in claim 11, wherein the pouch with an opening and a flap is made of material selected from the group consisting of leather, vinyl substitute leather, nylon, velvet, polyurethane fabric, polypropylene fabric, cotton, wool and silk.

13. A handbag comprising a pouch having an opening and a flap for closing said opening, at least one pair of soft, flexible pulley loops mounted externally one on each side, from one to four soft, flexible tension and balancing loops mounted externally to said pouch, as evenly divided as possible as to side of said pouch, and attached above said pulley loops, and single soft, flexible, continuous drawstring means passing through said loops and enclosed by and passing through a sewn edge of the flap transverse to said opening, whereby opening the flap pulls the single continuous drawstring means in one direction and pulling the drawstring means oppositely closes the flap.

* * * * *